US006182311B1

(12) United States Patent
Buchanan et al.

(10) Patent No.: US 6,182,311 B1
(45) Date of Patent: Feb. 6, 2001

(54) THERAPEUTIC BETWEEN-THE-LEGS SUPPORT PILLOW ASSEMBLY

(76) Inventors: Richard Lawrence Buchanan, 1430 Hurontario Street, Mississauga (CA), L5G 3H4; Luigi Anthony Daniel Berdusco, 5276 Lismic Boulevard, Mississauga (CA), L5V 1P2

( * ) Notice: Under 35 U.S.C. 154(b), the term of this patent shall be extended for 0 days.

(21) Appl. No.: 09/316,613

(22) Filed: May 21, 1999

(51) Int. Cl.[7] ..... A47C 20/00

(52) U.S. Cl. ..... 5/632; 5/648; 5/650; 602/26; 128/882; 128/845

(58) Field of Search ..... 5/632, 630, 648, 5/650; 602/23, 24, 26; 128/845, 846, 892, 882

(56) References Cited

U.S. PATENT DOCUMENTS

| | | | | |
|---|---|---|---|---|
| D. 342,856 | | 1/1994 | Hagen | D6/601 |
| 4,177,806 | * | 12/1979 | Griffin | 5/650 |
| 4,433,678 | | 2/1984 | Spann | 5/650 |
| 4,584,730 | | 4/1986 | Rajan | 5/632 |
| 4,736,477 | | 4/1988 | Moore | 5/650 |
| 4,777,678 | | 10/1988 | Moore . | |
| 4,910,818 | | 3/1990 | Grabill et al. . | |
| 5,117,522 | | 6/1992 | Everett | 5/648 |
| 5,125,123 | | 6/1992 | Engle | 5/648 |
| 5,418,991 | * | 5/1995 | Shiflett | 5/650 |
| 5,664,271 | | 9/1997 | Bellavance | 5/632 |
| 5,746,218 | * | 5/1998 | Edge | 5/648 |
| 5,878,453 | * | 3/1999 | Stokes | 5/630 |

OTHER PUBLICATIONS

Web page advertising on knee pillows at www.janlee.com (Janlee Enterprises, Highway 46, P.O. Box 5, Vienna, New Jersey, 07880, Tel. No.: 888–637–4600 Ext. 2, Fax No.: 908–637–8136).

* cited by examiner

*Primary Examiner*—Alexander Grosz
(74) *Attorney, Agent, or Firm*—Dinsmore & Shohl LLP

(57) ABSTRACT

An assembly of two therapeutic support pillows is provided: one pillow for placement between the thighs and another pillow for placement between the calves of a person resting on his or her side. The shapes of the pillows are carefully designed to closely conform to the shape of the human legs. Means are provided, which do not come between the knees, for connecting the two pillows together. Means are also provided for attaching the pillows to the user's legs.

27 Claims, 8 Drawing Sheets

THERAPEUTIC BETWEEN-THE-LEGS SUPPORT PILLOW ASSEMBLY

FIELD OF THE INVENTION

This invention relates to support pillows, and specifically to the design of therapeutic support pillows placed between the legs of a person lying on her or his side.

BACKGROUND OF THE INVENTION

Two thirds of North Americans sleep on their sides. While this position is very comfortable and is often recommended by medical practitioners, it causes bending of the spinal cord potentially leading to strain on the muscles, ligaments, bones, and joints; compression of the internal organs; decrease in blood flow; and irritation of the nerves. Also, resting on the side results in a prolonged contact of the thighs, knees, and calves potentially leading to obstruction of blood flow, painful cramps, and bruising.

These problems are exacerbated in people with medical problems, such as back pains due to trauma, various knee conditions, and arthritis. These problems are also exacerbated in obese people and pregnant women, who due to their large weight experience additional pressure on the lumbar spine, sacroiliac joint, sciatic nerve, and lower extremities and often have lower back pains, edema of legs, and varicose veins.

Also, certain medical conditions (and pregnancy is one of them) require everyday prolonged rest lying down, which in turn means prolonged contact of the legs and prolonged bending of the spine, potentially leading to all of the above described problems.

To alleviate the discomfort caused by these problems and to promote restful sleep, doctors have long recommended that patients place a pillow between their legs when sleeping on the side. Between-the-legs pillows facilitate the proper alignment of the spine, thighs, and calves relieving pain and discomfort, preventing gout, and improving general health. These pillows also relieve physical stress and strain after exercise.

Since conventional pillows are not shaped properly and are easily displaced during sleep, several specifically designed support pillows have been proposed in the prior art.

U.S. Pat. No. 4,584,730, to E. Rajan, shows a disc-shaped flat pillow with two basically parallel planar surfaces. This pillow has several protrusions used as means to space the pillow apart from the mattress. A person lying on his or her side can have one leg resting on the mattress (underneath the pillow) and the other leg resting on the upper surface of the pillow. This pillow also has protrusions confining the pelvis of the user. While this pillow separates the legs and aligns the spine, it is flat, does not conform to the shape of the human legs and, therefore, does not provide the maximum comfort to the user. Also, confining the pelvis is important only in special circumstances such as for handicapped children with brain disorders who have characteristic patterns of movement and resting positions gradually damaging their ability to sit. Pelvic restriction is unnecessary and uncomfortable in regular situations, because it restricts mobility and causes sweating and irritation of the pelvis. Overall, this pillow is very large, bulky and intended to restrict the movement of the user. Therefore, it is not convenient to use in casual situations.

U.S. Pat. No. 4,736,477, to G. Moore, shows a flat pillow for positioning between the person's knees, when he or she is required to recline to one side for a long time. The pillow is generally rectangular in planar form, and includes a series of notches permitting the pillow to deflect in a manner consistent with the movement of the knee. The pillow is fasten to the knee by a plurality of straps with hookable fasteners. While this pillow provides a cushioning and support for user's upper leg and helps to maintain the proper alignment of the spine, it has two limitations. First, this pillow is flat, does not conform to the shape of the human legs and, therefore, does not provide the maximum comfort and may even cause obstruction of blood flow in the legs. Second, this pillow contains cushioning for the knees which is undesirable because the knees are usually bony even in very obese people, the blood vessels are positioned close to the surface and are easily obstructed. Also, the back side of the knees contains sweat glands and cushioning will interfere with evaporation of the sweat, causing discomfort and irritation.

U.S. Pat. No. 5,117,522, to P. Everett, shows a flat rectangular pillow for placing between the person's legs while this person is lying on his or her back. The pillow is retained in its place between the legs by the shape (I-beam intersection) and by the flexible straps attached to the pillow for extension around the person's legs. The pillow has a transverse triangular notch that forms a hinge connection between two sections of the pillow allowing the person to comfortably bend his or her legs. Similar to the pillows described in the U.S. Pat. Nos. 4,584,730 and 4,736,477, this pillow is flat and contains cushioning between the knees, which makes it less comfortable for the user. Also, the straps attaching the pillow to the legs extend around both legs. This is a good solution in the case of a person resting on his or her back. However, if the pillow is to be used for resting on the side, the straps fitting underneath the legs may cause discomfort, bruising and irritation.

U.S. Pat. No. 5,664,271, to J. M. Bellavance, a pillow assembly for cushioning the body of a pregnant or obese person while this person is lying on her or his side and includes an abdominal pillow adapted to partially underlie the person's abdomen and a leg pillow adapted to be positioned between the person's legs. The leg pillow can be made as a single leg pillow extending from the person's upper thigh to the lower calf or as an assembly of two separate pillows (thigh and calf) interconnected by flap structures. The single leg pillow has the same basic limitations as the pillows described in the above U.S. Pat. Nos. 4,584,730, 4,736,477 and 5,117,522. The assembly of the two pillows is superior to the pillows described in these above patents in that it does not have the knee cushioning and is better fitted to the shape of the human legs. However, it is still not optimal for the user's comfort because it does not account for the natural asymmetry of the human thighs and calves. Also, the two flap structures connecting the pillows are positioned and attached to each other between the user's knees, which may cause irritation and bruising.

In conclusion, the prior art inventions provide a partial solution to the problems caused by an incorrect positioning of the body during sleeping or resting on one's side. However, all these inventions possess a number of limitations. These limitations are conveniently solved by the present invention, which in the course of extensive experimentation was found to possess more comfortable features and to greatly contribute to the health and well being of its users.

OBJECTS OF THE INVENTION

An object of the present invention is to provide an apparatus which overcomes the disadvantages of the prior art.

It is a related object of the present invention to provide an improved therapeutic support pillow for placement between the legs of a person lying on his or her side.

One general object of this invention is to provide the maximum comfort to the user while he or she is resting or sleeping on his or her side.

Another general object of this invention is to improve the general health of the user.

Another object of this invention is to assure the proper alignment of the spinal cord in order to prevent any strain on the muscles, ligaments, bones, and joints; compression of the internal organs; decrease in blood flow; and irritation of the nerves.

A further object of this invention is to minimize the prolonged contact of the thighs and calves in order to avoid obstruction of blood flow, painful cramps, and bruising.

Another object of this invention is to minimize any contact of the knees in order to avoid obstruction of blood flow as well as discomfort and irritation due to sweating.

Yet another object of this invention is to provide a between-the-legs pillow which does not unduly encumber or restrict the user allowing him or her to freely turn from side to side and to retain a great deal of mobility in the legs.

A further object of this invention is to provide a compact and easy-to-use between-the- legs pillow.

Another object of the present invention is to provide a between-the-legs pillow, which is comfortable and efficient for people of different sizes.

Additional objects and advantages of the invention will be apparent from the detailed description and the accompanying drawings.

SUMMARY OF THE INVENTION

This invention relates to support pillows, and specifically to the design of therapeutic support pillows placed between the legs of a person lying on her or his side.

Accordingly, the invention provides a between-the-legs support pillow which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is smaller than a distance between the right and left faces at the bottom edge; said between-the-legs support pillow also having a longitudinal axis, a width axis and a thickness axis, said longitudinal axis being the mid line in the longitudinal direction, said width axis being the mid line in the width direction, and said thickness axis being the mid line in the thickness direction, wherein said between-the-legs support pillow is asymmetric with respect to at least one of the axes.

In one embodiment of the between-the-legs support pillow, the top edge is convex arcuate in the width direction and the bottom edge is concave arcuate in the width direction.

In another embodiment of the between-the-legs support pillow, the front edge is convex arcuate in the length direction and the rear edge is either convex arcuate in the length direction or essentially straight.

In a further embodiment of the between-the-legs support pillow, the front edge is longer than the rear edge.

In yet another embodiment of the between-the-legs support pillow, a position where the distance between the right concave face and the left concave face in its minimum is closer to the rear edge than to the front edge of the pillow.

In another embodiment, the between-the-legs support pillow has a middle part extending between the front edge and the rear edge, said front and rear edges having comparable transverse thickness dimensions which are larger than the transverse thickness dimension of the middle part.

In yet another embodiment, the between-the-legs support pillow is made of resilient foam covered with removable fabric cover, wherein both the foam and the cover have absorbent properties to alleviate irritation caused by sweating.

In a further embodiment, the between-the-legs support pillow includes means for affixing the between-the-legs support pillow to a human leg.

In one embodiment these means comprise at least one side strap extending between the rear edge and the front edge of said pillow. This side strap may be permanently affixed at either the front or the rear edge of the pillow or the fabric cover of the pillow and may be removably attached to the opposite edge of the pillow or the fabric cover of the pillow. The removable attachment of the side strap(s) allows to adjust the length of the strap(s) and, thereby, maximizes the comfort of the user.

In a further embodiment, the side strap(s) are made of elastic material.

In another embodiment, the side straps are made of the same material as the fabric cover.

In a further embodiment, the between-the-legs support pillow is used in combination of two such pillows, one pillow placed between the thighs and the other pillow is placed between the calfs of the user.

The invention also provides a between-the-legs support pillow assembly comprising (a) a thigh pillow which has a top edge, a bottom edge, a front edge, a rear edge, a right face bounded by the top edge, the bottom edge, the front edge and the rear edge, and a left face bounded by the top edge, the bottom edge, the front edge and the rear edge, said. pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is smaller than a distance between the right and left faces at the bottom edge; (b) a calf pillow which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is larger than a distance between the right and left faces at the bottom edge; and (c) connecting means for connecting the thigh and calf pillows such that the bottom edge of the thigh pillow is separated from and proximal to the top edge of the calf pillow, said connecting means being flexible and connecting the thigh and calf pillows between any positions selected from the group consisting of the front edges of the thigh and calf pillows, the rear edges of the thigh and calf pillows and a combination thereof.

This invention also provides a between-the-legs support pillow assembly as described above, in which the thigh pillow has a longitudinal axis, a width axis and a thickness axis, said longitudinal axis being the mid line in the longitudinal direction, said width axis being the mid line in the width direction, and said thickness axis being the mid line in the thickness direction; the calf pillow has a longitudinal axis, a width axis and a thickness axis, said longitudinal axis being the mid line in the longitudinal direction, said width axis being the mid line in the width direction, and said thickness axis being the mid line in the thickness direction; and wherein at least one of the pillows is asymmetric with respect to at least one of its axes.

In one embodiment, the thigh pillow of the between-the-legs support pillow assembly has a middle part extending between the front edge and the rear edge, said front and rear edges having comparable transverse thickness dimensions which are larger than the transverse thickness dimension of the middle part.

In another embodiment, the calf pillow of the between-the-legs support pillow assembly has a middle part extending between the front edge and the rear edge, said front and rear edges having comparable transverse thickness dimensions which are larger than the transverse thickness dimension of the middle part.

In a further embodiment, the front and rear edges of the thigh pillow and the front and rear edges of the calf pillow have essentially the same transverse thickness.

In another embodiment, the top edge of the thigh pillow is convex arcuate in the width direction and the bottom edge of the thigh pillow is concave arcuate in the width direction.

In a further embodiment, the front edge of the thigh pillow is convex arcuate in the length direction and the rear edge of the thigh pillow is either convex arcuate in the length direction or essentially straight.

In another embodiment, front edge of the thigh pillow is longer than the rear edge of the thigh pillow.

In yet another embodiment, a position where the distance between the right concave face and the left concave face of the thigh pillow in its minimum is closer to the rear edge than to the front edge of the thigh pillow.

In another embodiment, the top edge of the calf pillow is convex arcuate in the width direction and the bottom edge of the thigh pillow is concave arcuate in the width direction.

In a further embodiment, the front edge of the calf pillow is convex arcuate in the length direction and the rear edge of the thigh pillow is either convex arcuate in the length direction or essentially straight.

In another embodiment, the front edge of the calf pillow is longer than the rear edge of the calf pillow.

In yet another embodiment, the position where the distance between the right concave face and the left concave face of the calf pillow in its minimum is closer to the rear edge than to the front edge of the calf pillow.

In another embodiment, both the thigh support pillow and the calf support pillow are made of resilient foam covered with removable fabric covers, wherein both the foam and the covers have absorbent properties to alleviate irritation caused by sweating.

In a further embodiment, the pillows are connected by a strap extending between adjacent ends of the front edges of the thigh and calf support pillows.

In another embodiment, the pillows are connected by a strap extending between adjacent ends of the rear edges of the thigh and calf support pillows.

In yet another embodiment, the pillows are connected by a strap extending between a front edge of one pillow and a rear edge of the other pillow.

There are embodiments in which the pillows are connected by two or more straps. These straps connect any positions selected from the group consisting of the front edges of the thigh and calf pillows, the rear edges of the thigh and calf pillows and a combination thereof. In the preferred embodiment, at least one strap is positioned in front and at least one strap is positioned behind the knees of the user. In the preferred embodiment, the straps are never positioned between the knees of the user where they can cause discomfort and irritation, e.g. the straps are never connected between the thigh and calf pillows from a positions midway along the lower edge of the thigh pillow and midway along the upper edge of the calf pillow. Other embodiments, however, may have the straps extending between the knees of the user.

In another embodiment, the strap is permanently affixed to the thigh and calf pillow or to the fabric covers of the thigh and the calf pillows.

In another embodiment, the strap is permanently affixed to either the thigh pillow or the calf pillow or, alternatively, to the fabric cover of either the thigh pillow or the calf pillow, and is removably attached to the other pillow or to the fabric cover of the other pillow in such a way as to allow the length of the strap to be adjustable for maximizing the comfort of the user.

In the preferred embodiment, the strap connecting the rear edges of the thigh and calf pillows is permanently attached to the fabric covers of the pillows while the strap connecting the front edges of the thigh and calf pillows is permanently attached to the fabric cover of the front end of the calf pillow and is removably attached to the fabric cover of the front end of the thigh pillow.

In a further embodiment, the between-the-legs support pillow assembly includes means for affixing the between-the-legs support pillow assembly to a human leg.

In another embodiment, the means for affixing the between-the-legs support pillow assembly to a human leg constitute at least one side strap on at least one of the two support pillows, wherein said side strap(s) extend between the rear edge and the front edge of said pillow.

In yet another embodiment, each side strap is permanently affixed at either the front or the rear edge of the corresponding pillow or the fabric cover of the corresponding pillow and is removably attached to the opposite edge of the corresponding pillow or the fabric cover of the corresponding pillow.

In a further embodiment, the removable attachment of the side strap(s) allows for adjusting the length of the strap(s) to maximize the comfort of the user.

In another embodiment, the side strap(s) are made of elastic material.

In yet another embodiment, the side straps may be made of the same material as the fabric cover.

Another aspect of the invention provides a method for alleviating discomfort in at least one of legs, lower back, and pelvis of a person, in which the method comprises (a) lying down on a side such that a first leg is in contact with a base member; (b) placing a between-the-legs support pillow, which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is smaller than a distance between the right and left faces at the bottom edge, over the first leg; and (c) placing a second leg on top of the pillow.

In one embodiment, in which the pillow has means for being affixed to a human leg, the method comprises a further step of (e) temporarily affixing this pillow to a leg selected from the group consisting of the first leg and the second leg.

This invention also provides a method for alleviating discomfort in at least one of legs, lower back, and pelvis of a person, in which the method comprises (a) lying down on a side such that a first leg is in contact with a base member; (b) placing a thigh pillow, which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is smaller than a distance between the right and left faces at the bottom edge, over a thigh of the first leg; (c) placing a calf pillow, which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is larger than a distance between the right and left faces at the bottom edge, over a calf of the first leg; and (d) placing a second leg on top of the thigh pillow and the calf pillow.

In one embodiment, in which the thigh and calf pillows have connecting means with adjustable length, the method further comprises a step of adjusting the length of the connecting means for maximum comfort of the user; said step may be performed before or after any of the other step in the method.

In another embodiment, in which at least one pillow has means for being affixed to a human leg, the method comprises a further step of (e) temporarily affixing this pillow to a leg selected from the group consisting of the first leg and the second leg.

In the preferred embodiment, the thigh and calf support pillows are used simultaneously as an assembly and contain the following features.

The thigh pillow (preferred embodiment)

The front edge is convex arcuate.

The rear edge is convex arcuate and is shorter than the front edge.

The top edge is convex arcuate.

The bottom edge is concave arcuate.

The right and left faces are both concave in the width direction and slightly skewed to the right i.e. the position where the distance between the right concave face and the left concave face of the thigh pillow is at its minimum is closer to the rear edge than to the front edge of the thigh pillow.

The transverse thickness of the front edge is equal to that of the rear edge and does not change along the length of the pillow.

The transverse thickness of the middle part is smaller than the transverse thickness of the edges.

The transverse thickness of the middle part increases from the top edge to the bottom edge.

The calf pillow (preferred embodiment)

The calf pillow is less wide and longer than the thigh pillow.

The front edge is convex arcuate.

The rear edge is convex arcuate and is shorter than the front edge.

The rear edge is more convex arcuate than the front edge.

The top edge is convex arcuate.

The bottom edge is concave arcuate.

The right and left faces are both concave in the width direction and slightly skewed to the right i.e. the position where the distance between the right concave face and the left concave face of the thigh pillow is at its minimum is closer to the rear edge than to the front edge of the calf pillow.

The transverse thickness of the front edge is equal to that of the rear edge and does not change along the length of the pillow.

The transverse thickness of the front and rear edges of the calf pillow equals to the transverse thickness of the front and rear edges of the thigh pillow.

The transverse thickness of the middle part is smaller than the transverse thickness of the edges.

The transverse thickness of the middle part decreases from the top edge to the bottom edge. The transverse thickness of the middle part of the calf pillow is generally greater than the transverse thickness of the middle part of the thigh pillow.

Common features (preferred embodiment)

Both pillows are made of a resilient material, e.g. foam, and are preferably covered with removable fabric covers. The foam and the covers are absorbent to prevent irritation due to sweating. They are also machine-washable. The thigh and calf pillows are connected by two straps, the front strap extending between adjacent ends of the front edges of the thigh and calf support pillows and the rear strap extending between adjacent ends of the rear edges of the thigh and calf support pillows. The straps are made of the same fabric as the pillows' covers. The rear strap is permanently attached to the pillows' covers. The front strap is permanently attached to the calf pillow's cover and removably attached to the thigh pillow's cover via a hook and loop fastener. The removable attachment allows to adjust the lengths of the straps for convenience of the user. In this preferred embodiment, the hook portion of the hook and loop fastener is on the strap and the loop portion of the hook and loop fastener is on the thigh pillow cover.

The thigh and calf support pillows also have means for being attached to the user's leg(s). This means comprise side straps made of elastic material. In this embodiment, the thigh pillow has one strap and the calf pillow has two straps. All of these straps extend from the rear to the front edges of the corresponding pillows over the right side for attachment to the right leg of the user. All three straps are permanently affixed to the rear edges of the corresponding pillows. All three straps are removably attached to the front edges of the corresponding pillows via a hook and loop fasteners which allow for easy installation around the user's leg and for adjusting the length of the straps for the maximum comfort. In this preferred embodiment, the hook portions of the hook and loop fasteners are on the straps and the loop portions of the hook and loop fasteners are on the pillow covers.

The present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description. Furthermore, all changes which come within the meaning and range of equivalency of the appended claims are therefore intended to be embraced therein.

DETAILED DESCRIPTION OF THE PREFERRED EMBODIMENT OF THE INVENTION

Figure 1:
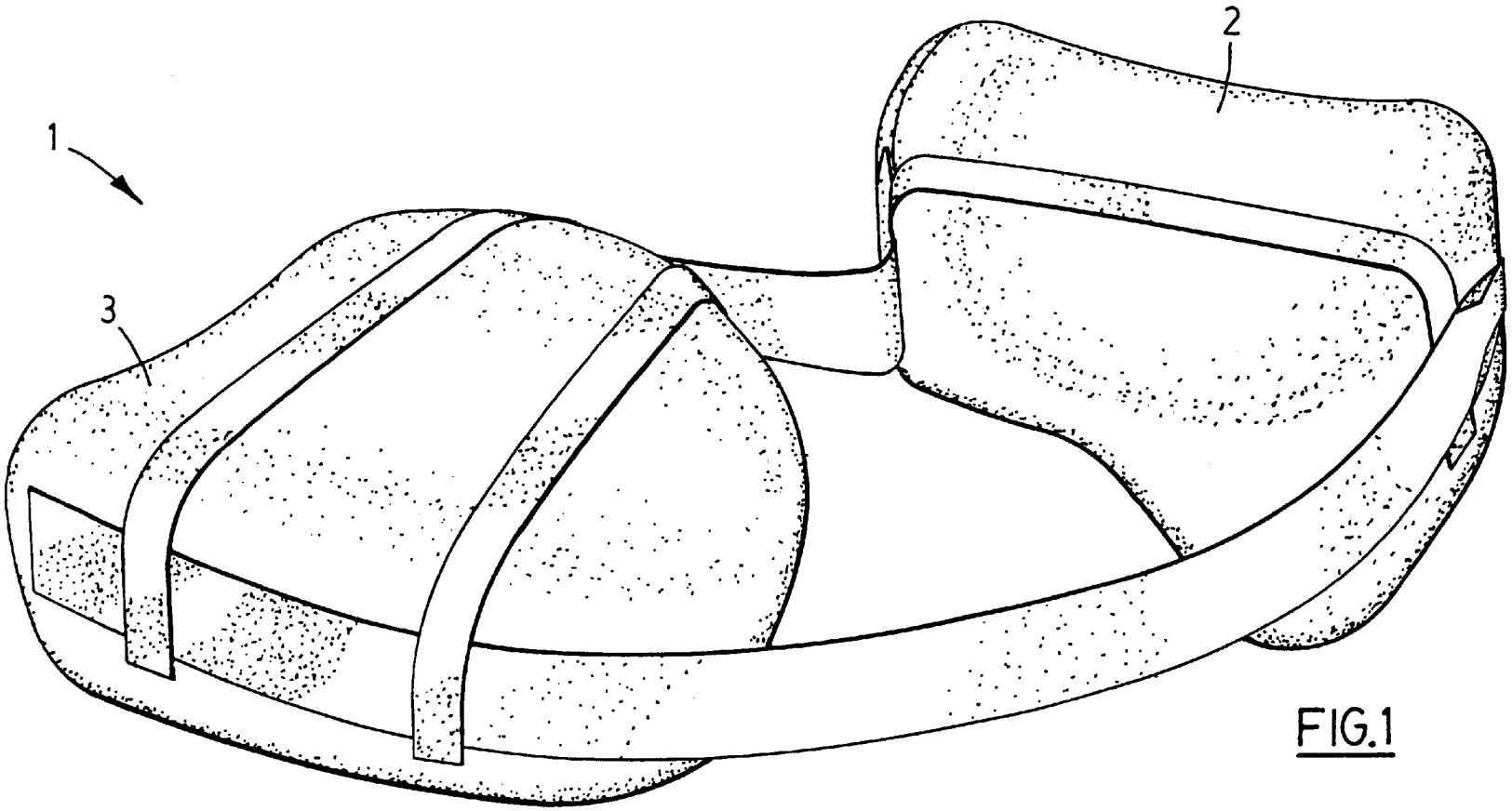
FIG. 1 is a right perspective view of the preferred embodiment of the between-the-legs support pillow assembly.
Figure 2:
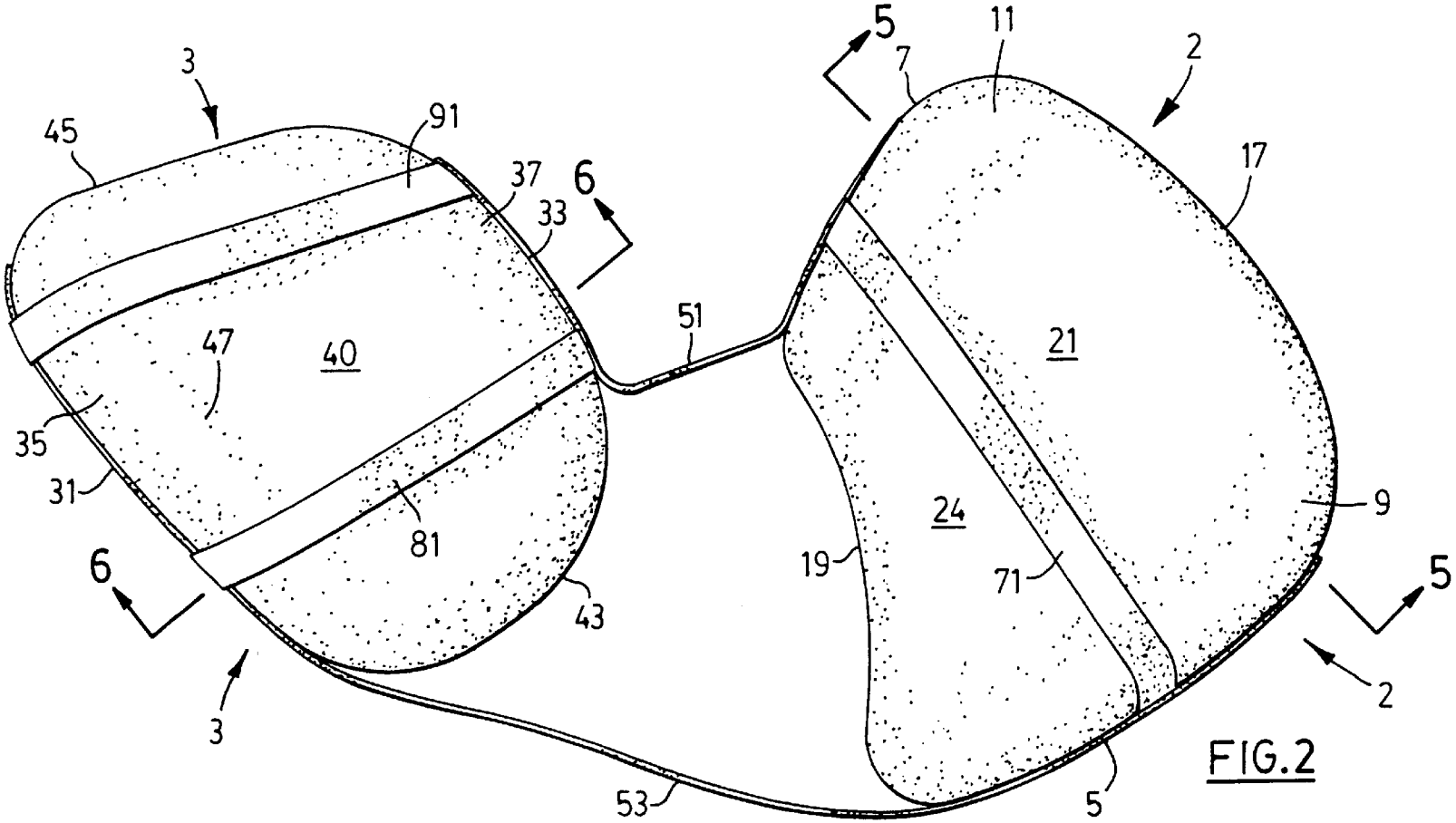
FIG. 2 is a right side view of the between-the-legs support pillow assembly of FIG. 1.
Figure 3:
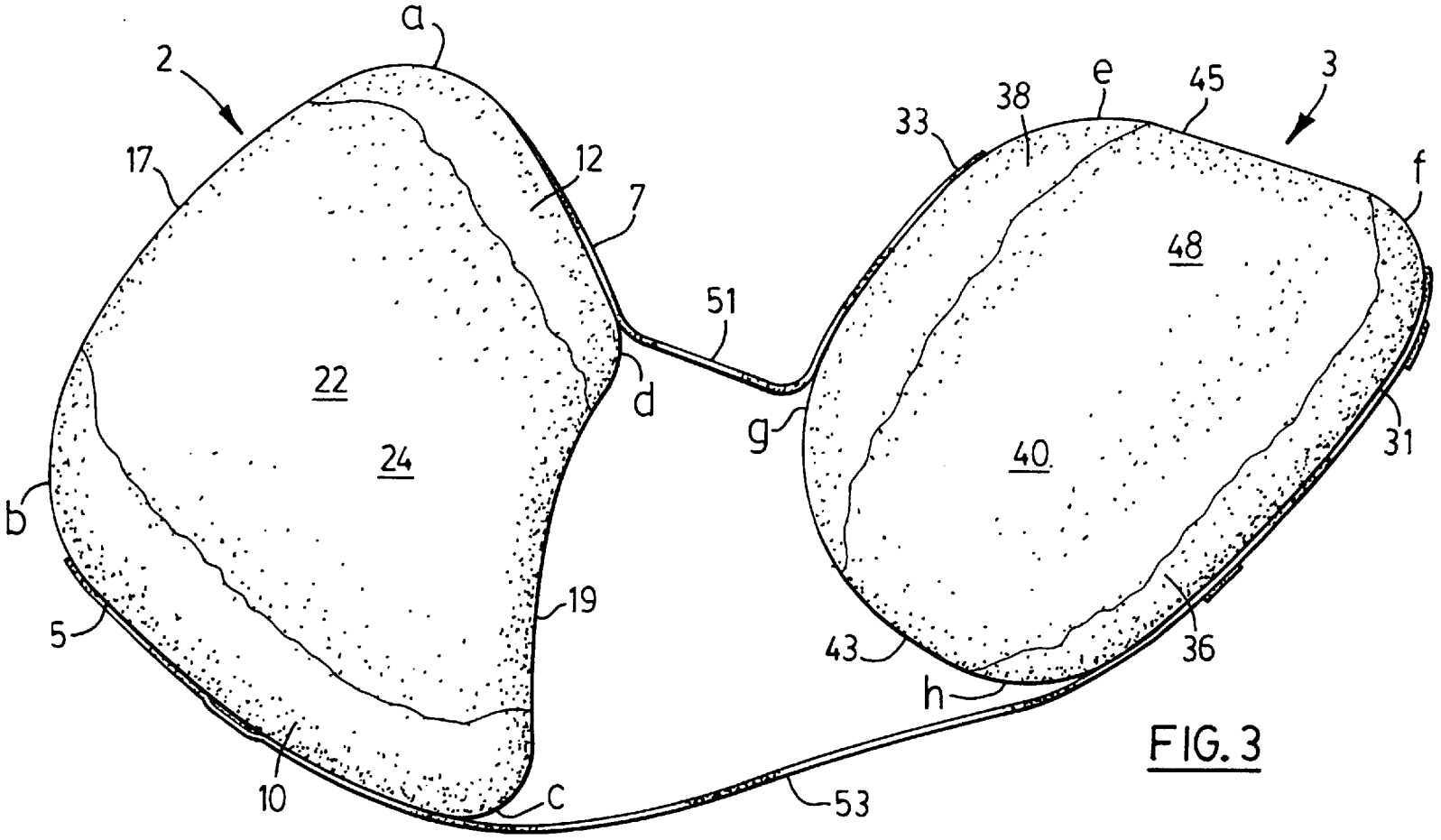
FIG. 3 is left side view of the between-the-legs support pillow assembly of FIG. 1.
Figure 4:
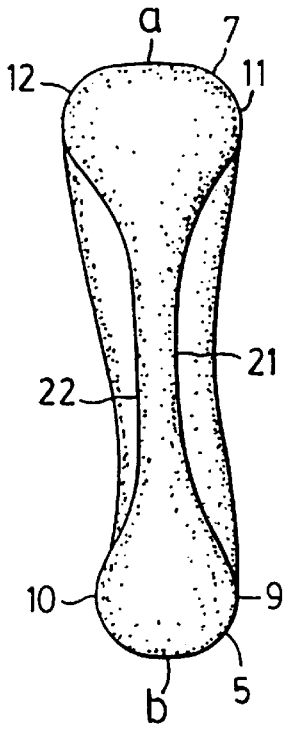
FIG. 4 is a top view of the preferred embodiment of the thigh pillow.
Figure 6:
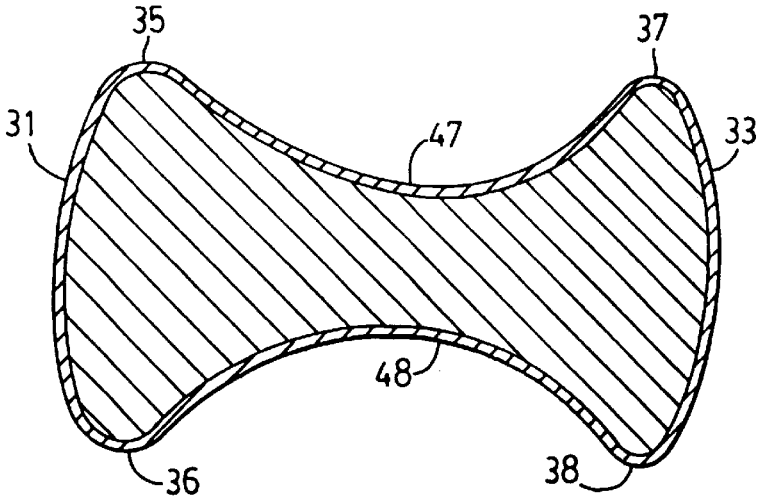
FIG. 6 is a transverse sectional view of the calf pillow of FIG. 1.
Figure 5:
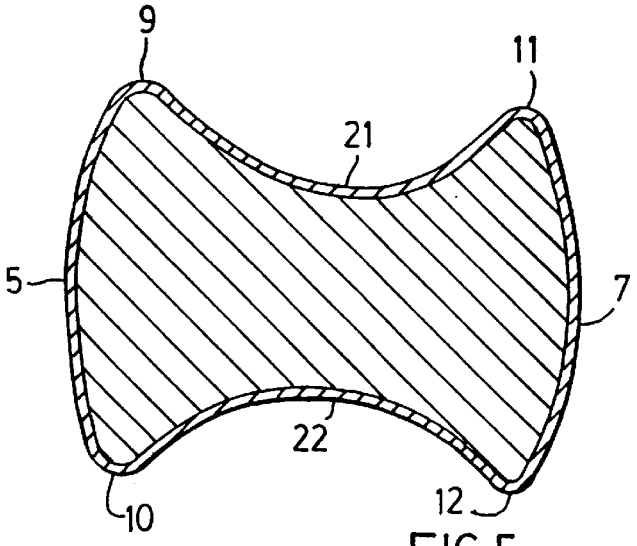
FIG. 5 is a transverse sectional view of the thigh pillow of FIG. 1.

As shown in FIG. 1, in the preferred embodiment of the between-the-legs support pillow assembly 1, the thigh support pillow 2 and the calf support pillow 3 are used together.

As shown in FIGS. 2, 3, 4, 5, and 6 the thigh support pillow 2 is defined by the front edge 5, rear edge 7, top edges 17, bottom edge 19, right side face 21 and left side face 22. The front edge 5 is convex arcuate in the longitudinal direction and is limited by comers b and c and rims 9 and 10. The rear edge 7 is convex arcuate in the longitudinal direction and is limited by corners a and d and rims 11 and 12. The rear edge 7 extending between the corners a and d is shorter than the front edge 5 extending between the corners b and c. The preferred length of the rear edge 7 is from about 7.5 to 8.5 inches. The preferred length of the front edge 5 is from about 10.5 to 11.5 inches. The preferred length of the thigh pillow 2 along its mid line is from about 9.5 to 10.5 inches. The transverse thickness of the front edge 5 (the distance between the rims 9 and 10) is equal to that of the rear edge 7 (the distance between the rims 11 and 12), does not change along the length of the thigh support pillow 2 and in the preferred embodiment equals from about 4.0 to 5.0 inches. The preferred width of the rims 9, 10, 11, and 12 is about 2.0 inches.

Figure 7:
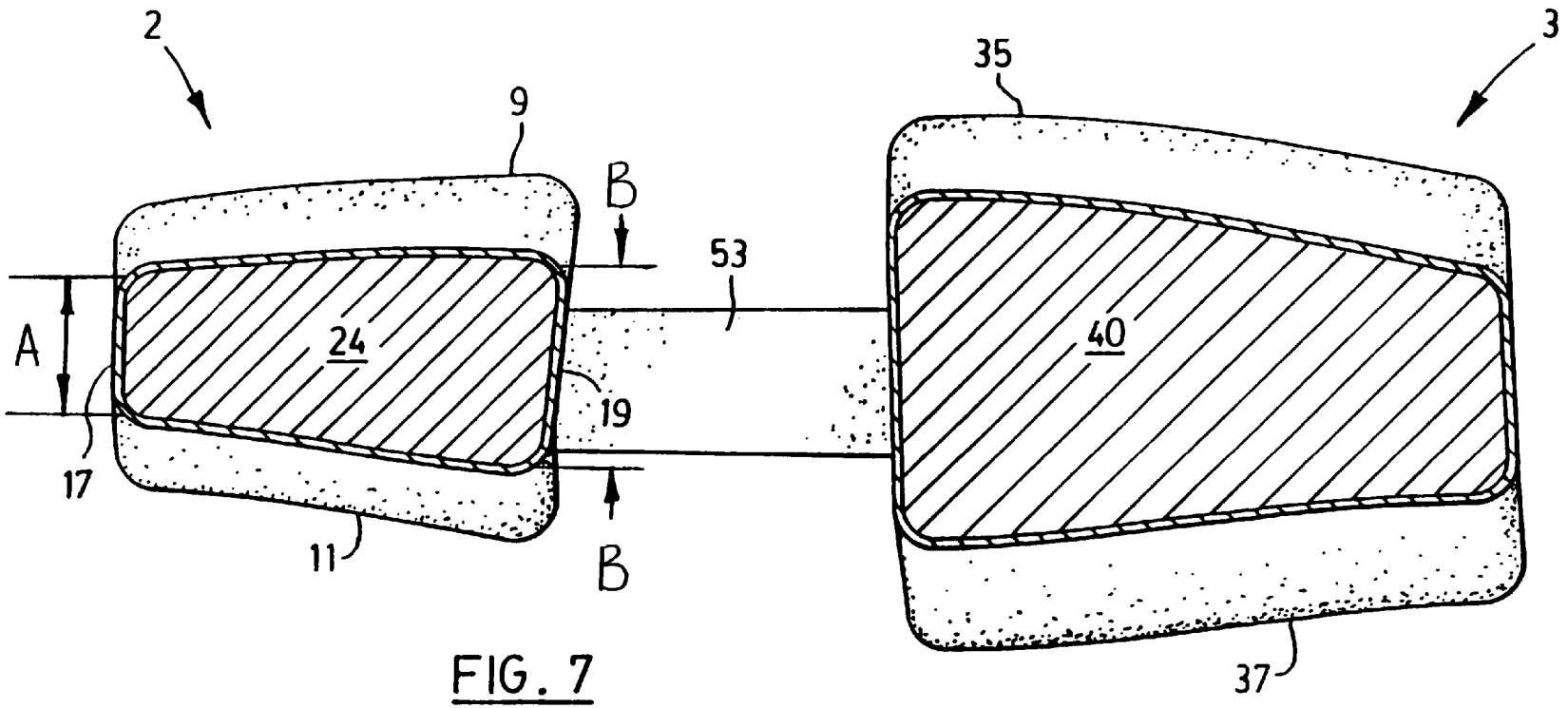
FIG. 7 is a longitudinal sectional view of the between-the-legs support pillow assembly of FIG.1.

The top edge 17 is convex arcuate in the width direction and extends between corners a and b. The bottom edge 19 is concave arcuate in the width direction and extends between corners c and d. The preferred length of the top edge 17 extending between the corners a and b is from about 10.5 to 11.5 inches. The preferred length of the bottom edge 19 extending between the corners c and d is from about 9.0 to 10.0 inches. The four edges (front 5, rear 7, top 17, and bottom 19) form borders for two opposite side faces: the right side face 21 and the left side face 22. The right side face 21 is for placement of the right thigh and the left side face 22 is for placement of the left thigh of the user. The right and left side faces 21 and 22 respectively are longitudinally concave and are slightly skewed to the rear edge 7 i.e. the position where the distance between faces 21 and 22 is at its minimum is slightly closer to the rear edge 7 than to the front edge 5 of the thigh pillow 2. The middle part 24 is the part between the front and rear edges 5 and 7. The transverse thickness of the middle part 24 is thinner than the transverse thickness of the front and rear edges 5 and 7. The transverse thickness of the middle part 24 gradually increases from the top edge 17 to the bottom edge 19. FIG. 7 shows transverse thickness of middle part 24, at the top edge 17, at double ended arrow A, and transverse thickness of middle part 24, at the bottom edge 19, at double ended arrow B. Typically, the transverse thickness of middle part 24, at the top edge 17, is from about 1.0 to 2.0 inches, and the transverse thickness of middle part 24, at the bottom edge 19, is from about 3.0 to 4.0 inches.

As shown in FIGS. 2, 3, 4,5, and 6 the calf support pillow 3 is defined by the front edge 31, rear edge 33, top edge 43, bottom edge 45, right side face 47 and left side face 48. The front edge 31 is convex arcuate in the longitudinal direction and is limited by corners f and h and rims 35 and 36. The rear edge 33 is convex arcuate in the longitudinal direction and is limited by corners e and g and rims 37 and 38. The rear edge 33 extending between the corners e and g is shorter than the front edge 31 extending between the corners f and h. The preferred length of the rear edge 33 is from about 9.0 to 10.0 inches. The preferred length of the front edge 31 is from about 11.5 to 12.5 inches. The preferred length of the calf pillow 3 along its mid line is from about 11.0 to 12.0 inches. The transverse thickness of the front edge 31 (the distance between the rims 35 and 36) is equal to that of the rear edge 33 (the distance between the rims 37 and 38), does not change along the length of the calf support pillow 3 and in the preferred embodiment equals to the transverse thickness of the front and rear edges 5 and 7 of the thigh support pillow 2. The preferred width of the rims 35, 36, 37, and 38 of the calf pillow 3 equals to that of the rims 9, 10, 11, and 12 of the thigh pillow 3.

The top edge 43 is convex arcuate in the width direction and extends between corners g and h. The bottom edge 45 is concave arcuate in the width direction and extends between corners e and f. The preferred length of the top edge 45 extending between the corners g and h is from about 7.5 to 8.5 inches. The preferred length of the bottom edge 45 extending between the corners e and f is from about 8.0 to 9.0 inches. The four edges (front 31, rear 33, top 43, and bottom 45) form borders for two opposite side faces: the right side face 47 and the left side face 48. The right side face 47 is for placement of the right calf and the left side face 48 is for placements of the left calf of the user. The right and left side faces 47 and 48 respectively are concave in the width direction and are slightly skewed to the rear edge 33 i.e. the position where the distance between faces 47 and 48 is at its minimum is slightly closer to the rear edge 33 than to the front edge 31 of the calf pillow 3. The middle part 40 is the part between the front and rear edges 31 and 33. The transverse thickness of the middle part 40 is thinner than the transverse thickness of the front and rear edges 31 and 33. The transverse thickness of the middle part 40 gradually increases from the top edge 43 to the bottom edge 45. FIG. 7 shows transverse thickness of middle part 40, at the top edge 43, at double ended arrow C, and transverse thickness of middle part 40, at the bottom edge 45, at double ended arrow D. Typically, the transverse thickness of middle part 40, at the top edge 43, is from about 3.5 to 4.5 inches, and the transverse thickness of middle part 40, at the bottom edge 45, is from about 2.0 to 3.0 inches.

Figure 10:
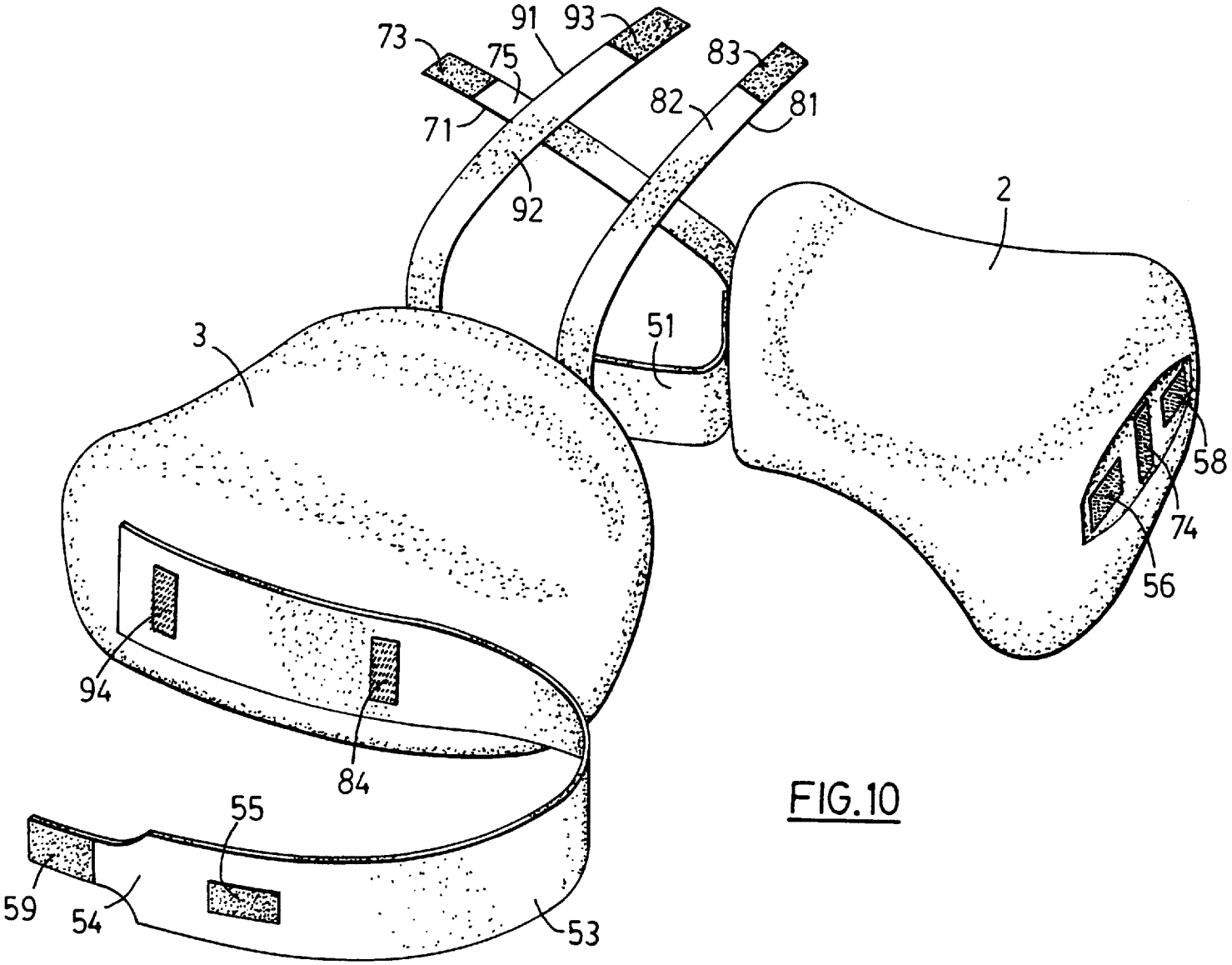
FIG. 10 is a right perspective view of the preferred embodiment of the between-the-legs support pillow assembly of FIG. 1 with the straps disattached from the pillow cover.

As shown in FIGS. 2, 3, 8, 9 and 10 the thigh support pillow 2 and the calf support pillow 3 are attached to each other by two straps 51 and 53. The strap 51 extends behind the knees of the user and is permanently affixed to the fabric covers of the thigh and the calf support pillows 2 and 3. The preferred length of the strap 51 is from about 4.0 to 5.0 inches. The strap 53 extends in front of the knees of the user and is permanently affixed to the fabric cover of the calf support pillow 3. The strap 53 is removably attachable to the fabric cover of the thigh support pillow 2 by a series of hook and loop fasteners 55–56 and 59–58, as shown in FIG. 10. The hook portions 55 and 59 of the hook and loop fasteners 55–56 and 59–58 are located on the inside face 54 of the strap 53. The loop portions 56 and 58 are located on the fabric cover of the front edge of the thigh support pillow 2. Preferably, the length of the strap 53 is at least 18.0 inches and is adjustable via the above mentioned hook and loop fasteners 55–56 and 59–58. As an alternative, strap 53 may be permanently fixed to the fabric cover of thigh support pillow 2 and removably attached to calf pillow 3 by appropriate means as will be understood by those skilled in the art, e.g. using loop and hook fasteners.

Figure 8:
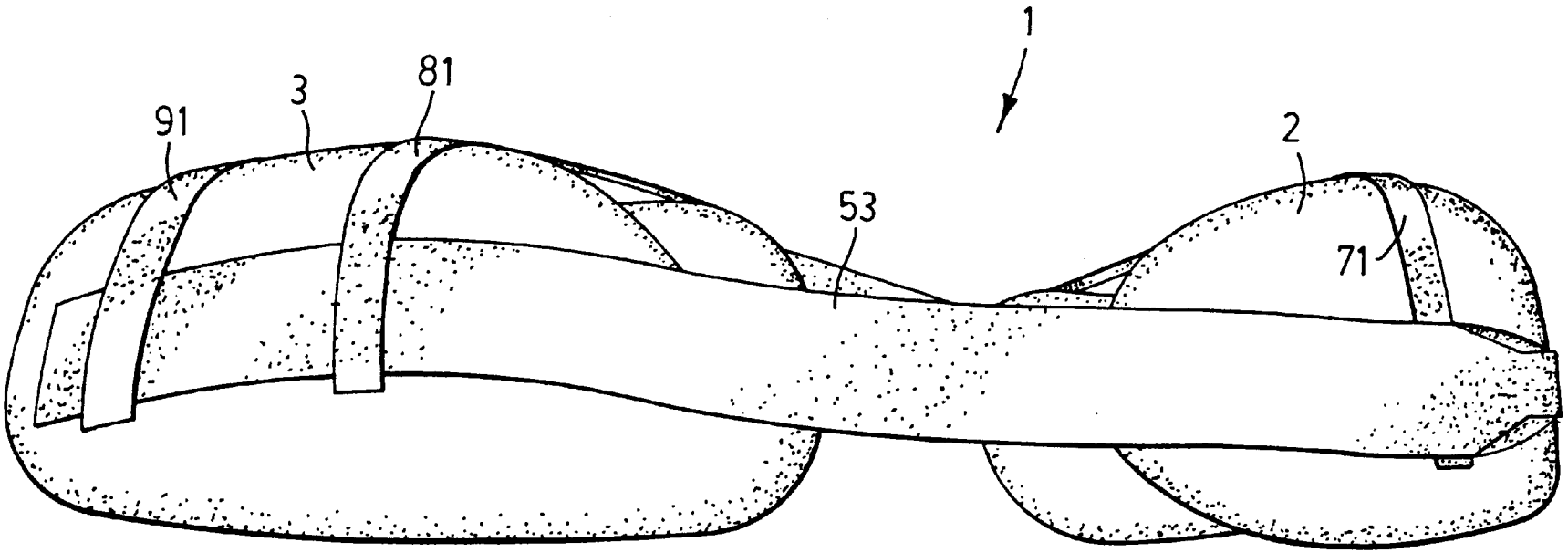
FIG. 8 is a front perspective view of the between-the-legs support pillow assembly of FIG. 1.
Figure 9:
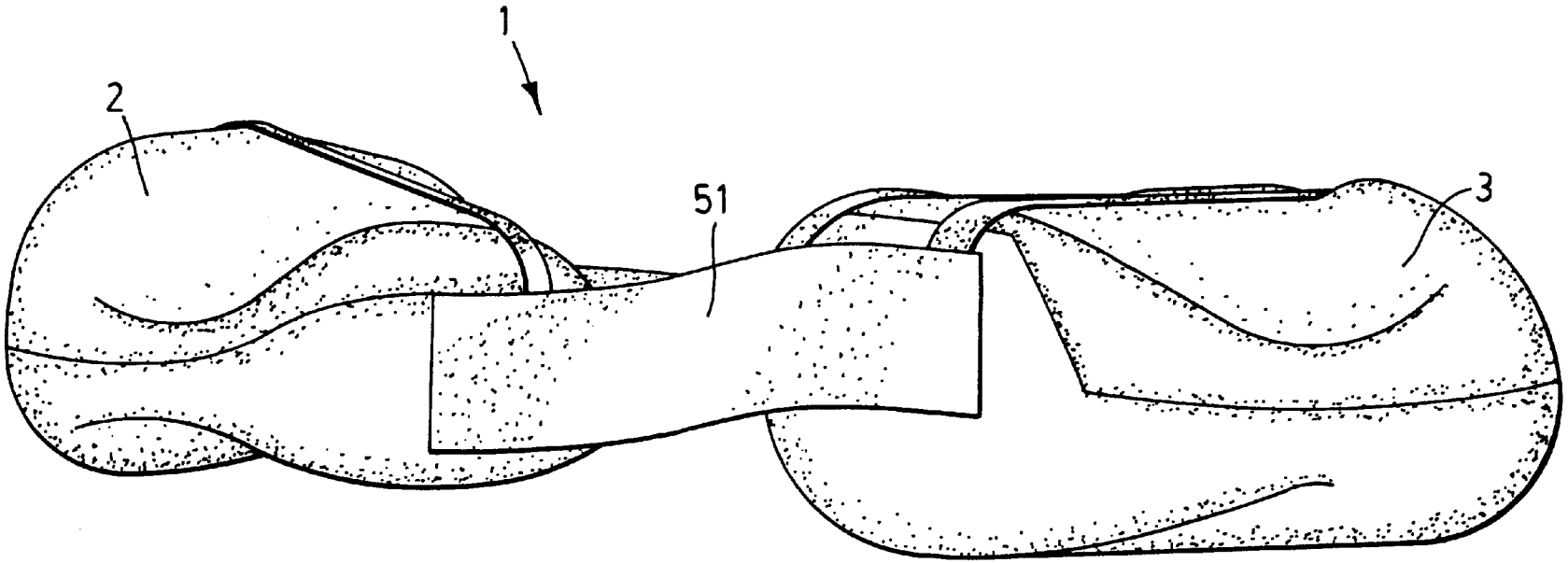
FIG. 9 is a rear perspective view of the between-the-legs support pillow assembly of FIG. 1.

The thigh support pillow 2 may also have a side strap 71, as shown in FIGS. 8 and 10, for being attached to the thigh of the user's right leg. This strap extends from the rear edge 7 over the right side face 21 to the front edge 5 of the thigh support pillow 2. The strap 71 is permanently affixed to the fabric cover of the rear edge 7 and is removably attachable to the fabric cover of the front edge 5 via the hook and loop fastener 73–74. The hook portion 73 of the hook and loop fastener 73–74 is located on the inside face 75 of the strap 71. The loop portion 74 is located on the fabric cover of the front edge 5 of the thigh support pillow 2. Preferably, the length of the strap 71 is at least 16 inches and is adjustable via the above mentioned hook and loop fastener 73–74. As an alternative, strap 71 may be permanently fixed to the fabric cover of front edge 5 and removably attached to the rear edge 7 by appropriate means as will be understood by those skilled in the art, e.g. using loop and hook fasteners.

The calf support pillow 3 may also have two side straps 81 and 91 for attaching the calf support pillow 3 to the right calf of the user. These side straps 81 and 91 are designed in the same way as the side strap 71 of the thigh support pillow 2. Both side straps 81 and 91 are permanently affixed to the fabric cover of the rear edge 33 of the calf support pillow 3. They both extend over the right side face 47 of the calf support pillow 3 and are removably attachable to the fabric cover of the front edge 31 of the calf support pillow 3 by the hook and loop fasteners 83–84 and 93–94. The hook portions 83 and 93 of the hook and loop fasteners 83–84 and 93–94 are located on the inside faces 82 and 92 of the straps 81 and 91. The loop portions 84 and 94 are located on the fabric cover of the front edge 31 of the calf support pillow 3. Preferably, the lengths of the straps 81 and 91 are at least 11 inches and are adjustable via the above mentioned hook and loop fasteners 83–84 and 93–94. As an alternative, straps 81 and 91 may be permanently fixed to the fabric cover of front edge 31 and removably attached to the rear edge 33 by appropriate means as will be understood by those skilled in the art, e.g. using loop and hook fasteners. Furthermore, it will be understood that, in the embodiment shown in FIG. 10, strap 73 must be attached to the fabric cover of the front edge 5 of the thigh support pillow 2 at fastener 73–74 before strap 53 is attached to the fabric cover of the front edge 5 of the thigh pillow 2 at fasteners 55–56 and 59–58.

Due to their specifically designed asymmetries, the thigh and the calf pillows closely conform to the asymmetries of the human thighs and calves, and thereby prevent various medical problems resulting from obstruction of blood flow, bruising, and chafing of the skin occurring when the existing symmetrical between-the-legs pillows are used. During the course of experimentation, in which between-the-legs pillows of various shapes and sizes were tested, the pillow assembly of the present invention was found to provide the greatest comfort and the most restful sleep to the users. It works well in people as short as 4 feet 6 inches and as tall as 6 feet and 6 inches in height. Also, when used together, the thigh and calf pillows of the present invention may be attached to each other by an improved means, which do not extend between the knees of the user, thereby avoiding any possibility of chafing of the skin, bruising, and irritation in this region. Moreover, this new pillow assembly does not unduly encumber or restrict the user allowing him or her to bend the legs and to freely turn from side to side. In addition, this pillow is very easy to use and compact to store.

What is claimed is:

1. A between-the-legs support pillow assembly comprising (a) a thigh pillow which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is smaller than a distance between the right and left faces at the bottom edge;

(b) a calf pillow which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is larger than a distance between the right and left faces at the bottom edge;

(c) connecting means for connecting the thigh and calf pillows such,n that the bottom edge of the thigh pillow is separated from and proximal to the top edge of the calf pillow, said connecting means being flexible and connecting the thigh and calf pillows between any positions selected from the group consisting of the front edges of the thigh and calf pillows, the rear edges of the thigh and calf pillows and a combination thereof.

2. A between-the-legs support pillow assembly as recited in claim 1, wherein the thigh pillow has a middle part extending between the front edge and the rear edge, said front and rear edges having comparable transverse thickness dimensions which are larger than the transverse thickness dimension of the middle part.

3. A between-the-legs support pillow assembly as recited in claim 1, wherein the calf pillow has a middle part extending between the front edge and the rear edge, said front and rear edges having comparable transverse thickness dimensions which are larger than the transverse thickness dimension of the middle part.

4. An improved between-the-legs support pillow assembly as recited in claim 1, wherein the front and rear edges of the thigh pillow and the front and rear edges of the calf pillow have essentially the same transverse thickness.

5. A between-the-legs support pillow assembly as recited in claim 1, wherein the thigh pillow has a longitudinal axis, a width axis and a thickness axis, said longitudinal axis being the mid line in the longitudinal direction, said width axis being the mid line in the width direction, and said thickness axis being the mid line in the thickness direction; the calf pillow has a longitudinal axis, a width axis and a thickness axis, said longitudinal axis being the mid line in the longitudinal direction, said width axis being the mid line in the width direction, and said thickness axis being the mid line in the thickness direction; and wherein at least one of the pillows is asymmetric with respect to at least one of its axes.

6. A between-the-legs support pillow assembly as recited in claim 5, wherein the top edge of the thigh pillow is convex arcuate in the width direction and the bottom edge of the thigh pillow is concave arcuate in the width direction.

7. A between-the-legs support pillow assembly as recited in claim 5, wherein the front edge of the thigh pillow is convex arcuate in the longitudinal direction and the rear edge of the thigh pillow is either convex arcuate in the longitudinal direction or essentially straight.

8. A between-the-legs support pillow assembly as recited in claim 5, wherein the front edge of the thigh pillow is longer than the rear edge of the thigh pillow.

9. A between-the-legs support pillow assembly as recited in claim 5, wherein a position where the distance between the right concave face and the left concave face of the thigh pillow in its minimum is closer to the rear edge than to the front edge of the thigh pillow.

10. A between-the-legs support pillow assembly as recited in claim 5, wherein the top edge of the calf pillow is convex arcuate in the width direction and the bottom edge of the thigh pillow is concave arcuate in the width direction.

11. A between-the-legs support pillow assembly as recited in claim 5, wherein the front edge of the calf pillow is convex arcuate in the length direction and the rear edge of the thigh pillow is either convex arcuate in the length direction or essentially straight.

12. A between-the-legs support pillow assembly as recited in claim 5, wherein the front edge of the calf pillow is longer than the rear edge of the thigh pillow.

13. A between-the-legs support pillow assembly as recited in claim 5, wherein a position where the distance between the right concave face and the left concave face of the calf pillow in its minimum is closer to the rear edge than to the front edge of the calf pillow.

14. A between-the-legs support pillow assembly as recited in claim 1, wherein both the thigh support pillow and the calf support pillow are made of resilient foam covered with removable fabric covers, wherein both the foam and the covers have absorbent properties to alleviate irritation caused by sweating.

15. A between-the-legs support pillow assembly as recited in claim 1, wherein the connecting means comprise a strap extending between positions selected from the group consisting of the front edges of the thigh and calf pillows, the rear edges of the thigh and calf pillows, and a combination thereof.

16. A between-the-legs support pillow assembly as recited in claim 15, wherein the strap is permanently affixed to the thigh and calf pillow or to the fabric covers of the thigh and the calf pillows.

17. A between-the-legs support pillow assembly as recited in claim 15, wherein the strap is permanently affixed to either the thigh pillow or the calf pillow or, alternatively, to the fabric cover of either the thigh pillow or the calf pillow, and is removably attached to the other pillow or to the fabric cover of the other pillow in such a way as to allow the length of the strap to be adjustable for maximizing the comfort of the user.

18. A between-the-legs support pillow assembly as recited in claim 1, wherein the connecting means comprise a strap extending between adjacent ends of the rear edges of the thigh and calf support pillows.

19. A between-the-legs support pillow assembly as recited in claim 1, wherein the connecting means comprise a strap extending between adjacent ends of the front edges of the thigh and calf support pillows.

20. A between 4 he-legs support pillow assembly as recited in claim 1, which further includes means for affixing the between-the-legs support pillow assembly to a human leg.

21. A between-the-legs support pillow assembly as recited in claim 20, wherein the means for affixing the between-the-legs support pillow assembly to a human leg constitute at least one side strap on at least one of the two support pillows, wherein said side strap(s) extend between the rear edge and the front edge of said pillow.

22. A between-the-legs support pillow assembly as recited in claim 20, wherein each side strap is permanently affixed at either the front or the rear edge of the corresponding pillow or the fabric cover of the corresponding pillow and is removably attached to the opposite edge of the corresponding pillow or the fabric cover of the corresponding pillow.

23. A between-the-legs support pillow assembly as recited in claim 22, wherein the removable attachment of the side strap(s) allows for adjusting the length of the strap(s) to maximize the comfort of the user.

24. A between-the-legs support pillow assembly as recited in claim 20, wherein the side strap(s) are made of elastic material.

25. A method for alleviating discomfort in at least one of legs, lower back, and pelvis of a person, in which the method comprises (a) lying down on a side such that a first leg is in contact with a base member;

(b) placing a thigh pillow, which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is smaller than a distance between the right and left faces at the bottom edge, over a thigh of the first leg;

(c) placing a calf pillow, which has a top edge, a bottom edge, a front edge, a rear edge, a right face bounded by the top edge, the bottom edge, the front edge and the rear edge, and a left face bounded by the top edge, the bottom edge, the front edge and the rear edge, said pillow having a longitudinal direction, a width direction and a thickness direction, said top and bottom edges being in the width direction and said front and rear edges being in the longitudinal direction, wherein the right and left faces are each concave in the width direction, the right and left faces tapering towards one another in the longitudinal direction such that a distance between the right and left faces at the top edge is larger than a distance between the right and left faces at the bottom edge, over a calf of the first leg;

(d) placing a second leg on top of the thigh pillow and the calf pillow.

26. A method for alleviating discomfort in at least one of legs, lower back, and pelvis of a person as recited in claim 25, in which the thigh and calf pillows have connecting means with adjustable length and wherein the method comprises an additional step of adjusting the length of the connecting means for maximum comfort of the user; said step performed before or after any of the steps of claim 25.

27. A method for alleviating discomfort in at least one of legs, lower back, and pelvis of a person as recited in claim 25, in which at least one pillow has means for being affixed to a human leg and wherein the method comprises an additional step of (e) temporarily affixing this pillow to a leg selected from the group consisting of the first leg and the second leg.

* * * * *

UNITED STATES PATENT AND TRADEMARK OFFICE

CERTIFICATE OF CORRECTION

PATENT NO. : 6,182,311 B1
DATED : February 6, 2001
INVENTOR(S) : Richard L. Buchanan et al.

It is certified that error appears in the above-identified patent and that said Letters Patent is hereby corrected as shown below:

Claim 1, column 13,
Line 2, delete ", n".

Claim 20, column 14,
Line 36, change "20. A between 4 he-legs" to -- 20. A between-the-legs --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*